US007100393B2

(12) United States Patent
D'Angelo

(10) Patent No.: US 7,100,393 B2
(45) Date of Patent: Sep. 5, 2006

(54) BEVERAGE COOLER WITH ADJUSTABLE PLATFORM

(76) Inventor: Frank D'Angelo, 2103 Virginia Rd., Los Angeles, CA (US) 90016

( * ) Notice: Subject to any disclaimer, the term of this patent is extended or adjusted under 35 U.S.C. 154(b) by 7 days.

(21) Appl. No.: 10/883,545

(22) Filed: Jul. 1, 2004

(65) Prior Publication Data

US 2006/0000229 A1 Jan. 5, 2006

(51) Int. Cl.
*F25D 3/08* (2006.01)

(52) U.S. Cl. ..... 62/372; 62/457.2; 62/459

(58) Field of Classification Search ..... 62/371, 62/372, 245, 329, 459, 464, 457.1, 457, 457.8, 62/529, 246, 457.2
See application file for complete search history.

(56) References Cited

U.S. PATENT DOCUMENTS

| | | | | |
|---|---|---|---|---|
| 3,738,619 | A * | 6/1973 | Shirae | 366/98 |
| 4,265,095 | A * | 5/1981 | McConachie | 62/373 |
| 4,974,426 | A | 12/1990 | Gomez et al. | |
| 5,048,305 | A | 9/1991 | Taub | |
| 5,090,214 | A | 2/1992 | LoGioco | |
| 5,316,170 | A * | 5/1994 | Brown | 220/495.06 |
| 5,433,085 | A | 7/1995 | Rogers | |
| 5,564,288 | A | 10/1996 | Lewis | |
| 5,596,880 | A | 1/1997 | Welker et al. | |
| 5,816,432 | A | 10/1998 | Hammen et al. | |
| 5,845,515 | A | 12/1998 | Nelson | |
| 6,026,978 | A | 2/2000 | Clegg et al. | |
| 6,062,411 | A | 5/2000 | Garland, Jr. | |
| 6,276,162 | B1 | 8/2001 | Schemel | |
| 6,314,751 | B1 * | 11/2001 | Gjersvik | 62/457.4 |
| 6,349,559 | B1 | 2/2002 | Hasanovic | |
| 6,381,981 | B1 * | 5/2002 | Yaddgo et al. | 62/372 |
| 6,419,108 | B1 * | 7/2002 | Toida et al. | 220/592.17 |
| 6,536,620 | B1 * | 3/2003 | Moran | 215/396 |
| 6,557,594 | B1 * | 5/2003 | Guzman | 141/240 |
| 6,626,006 | B1 | 9/2003 | Tedder | |
| 6,695,563 | B1 * | 2/2004 | Guzman | 414/405 |
| 6,698,230 | B1 | 3/2004 | Brusky | |

FOREIGN PATENT DOCUMENTS

JP 7-215343 A * 8/1995

* cited by examiner

*Primary Examiner*—Mohammad M. Ali
(74) *Attorney, Agent, or Firm*—David A. Belasco; Belasco, Jacobs & Townsley, LLP

(57) ABSTRACT

A beverage cooler includes a receptacle, adjustable platform and raising mechanism. The receptacle has a bottom, walls and an open top. The platform has at least one orifice, at least one guide and a threaded orifice. The raising mechanism includes at least one track, a threaded shaft and a rotating mechanism to move the platform between an upper and lower position. The rotating mechanism is a crank or an electric motor. In another variant, the threaded shaft is located centrally on the bottom with the mating threaded orifice located centrally on the platform. In yet another variant, the threaded shaft is located adjacent an edge on the bottom with the threaded orifice located adjacent an edge of the platform. In other variants of the invention, the receptacle includes insulation, wheels, handles, a drain opening and an inner wall, outer wall and an evacuated space between the inner and outer wall.

18 Claims, 4 Drawing Sheets

BEVERAGE COOLER WITH ADJUSTABLE PLATFORM

FIELD OF INVENTION

The invention pertains to beverage coolers. More particularly, the invention relates to beverage coolers with adjustable platforms.

BACKGROUND OF THE INVENTION

Various types of beverage coolers have been developed for providing easy access to canned or bottled beverages contained in a cooler with ice.

U.S. Pat. No. 5,596,880, issued to Welker et al., is directed to a chilled beverage display container adapted to hold ice and beverages separate from water formed from melted ice. A float having a density less than water is adapted to support the ice and beverages and move upwardly within the cavity as the ice melts.

U.S. Pat. No. 5,433,085, issued to Rogers is directed to a cooler with floating section. An outer container and a buoyant inner container assembly within the outer container is included. The inner container is dimensioned to slide vertically within the outer container and a container recess is provided in the upper surface of the inner container assembly to hold beverage containers and ice. The inner container assembly has a buoyancy which will float it upon the liquid which is drained into the outer container.

U.S. Pat. No. 5,564,288 issued to Lewis describes an apparatus for organizing articles inside a portable cooler. A base having a channel defined therein provides an interconnecting structure for a plurality of tubular members. The tubular members have a flange at one end that fits into the channel on the base and slide onto the base from either of two open ends of the tubular members. The tubular members are capable of sliding in the channels from one end to the other. Accordingly, the base provides a structure for interconnecting the tubular members and for providing stability to the tubular members once the cooler or ice chest is loaded with ice.

U.S. Pat. No. 6,062,411 issued to Garland, Jr. discloses a cooler chest with ice-surrounded food compartment. The ice-surrounded food compartment includes an outer container that supports an outer lid. An inner container having an inner lid is carried within the outer container. In use, a portion of the base of the inner container is inserted into the recessed region defined in the base of the outer container. The inner container is thermally conductive between its outer and inner surfaces and allows heat to be transferred from items of food stored within the inner container to ice and water carried within the ice storage area defined between the outer and inner containers.

U.S. Pat. No. 6,349,559 issued to Hasanovic discloses an ice chest and insert. An ice chest is comprised of an insulating base and insulating sidewalls upstanding from the base. Within the container is a false floor supported in spaced relation from the insulating base and having a perimeter located close or adjacent to the insulating sidewalls. An ice feed tube secured to the false floor has a bore opening into the space between false floor and the insulating base. The bore permits passage of ice pieces through the bore into the space between the false floor and the insulating base. The false floor permits heat transfer across its thickness, thereby facilitating cooling of articles located on and above the false floor.

While other variations exist, the above-described designs for height adjustable beverage coolers are typical of those encountered in the prior art. It is an objective of the present invention to provide a beverage cooler that provides convenient access to canned or bottled beverages contained within ice. It is a further objective to provide such access in a beverage cooler that provides optimal cooling conditions for canned or bottled beverages. It is yet a further objective to provide a beverage cooler that may be easily cleaned and stored. It is an additional objective of the invention that the beverage cooler may be easily fabricated from standard and readily available components. It is a final further objective of the invention to provide the above-described capabilities in an inexpensive and durable beverage cooler that is capable of extended use.

While some of the objectives of the present invention are disclosed in the prior art, none of the inventions found include all of the requirements identified.

SUMMARY OF THE INVENTION

The present invention addresses all of the deficiencies of prior art beverage coolers and satisfies all of the objectives described above.

(1) A beverage cooler of the present invention may be constructed from the following components. A receptacle is provided. The receptacle has an adjustable platform therein. The platform has at least one orifice, therethrough. A raising mechanism is provided. The raising mechanism moves the platform between an upper position and a lower position.

(2) In a variant of the invention, the receptacle includes a bottom, a continuous side wall extending upwardly from the bottom and ending at an open top.

(3) In another variant, the raising mechanism includes at least one track. The track is located upon an inner surface of the side wall. At least one guide is provided. The guide is located at an outer edge of the platform. A threaded shaft is provided. A mating threaded orifice located in the platform is provided. A rotating mechanism attached to the threaded shaft is provided.

(4) In still another variant, the threaded shaft has a first end, a second end and engages a lower bearing secured to the bottom.

(5) In yet another variant of the invention, the threaded shaft is located centrally on the bottom and the mating threaded orifice is located centrally on the platform.

(6) In another variant, the rotating mechanism is a crank.

(7) In still yet another variant, the crank is removably attached to the threaded shaft.

(8) In another variant of the invention, the rotating mechanism is an electric motor.

(9) In still another variant, the electric motor is removably attached to the threaded shaft.

(10) In yet another variant, a top support bracket is provided. The top support bracket is located at an upper edge of the side wall.

(11) In another variant of the invention, the top support bracket is removably attached to the upper edge of the side wall.

(12) In still yet another variant, the top support bracket further includes an orifice sized and shaped to fit slidably over the threaded shaft.

(13) In still another variant of the invention, the top support bracket includes at least one bearing.

(14) In a yet another variant, the receptacle includes insulation.

(15) In yet another variant of the invention, the receptacle includes a drain opening.

(16) In still yet another variant, the receptacle includes at least two wheels.

(17) In another variant, the receptacle includes at least one handle.

(18) In still another variant of the invention, the receptacle includes an inner wall, an outer wall and an evacuated space between the inner wall and the outer wall.

(19) In a final variant of the invention, the threaded shaft is located adjacent to an edge of the bottom and the mating threaded orifice is located adjacent an edge of the platform.

Figure 1:
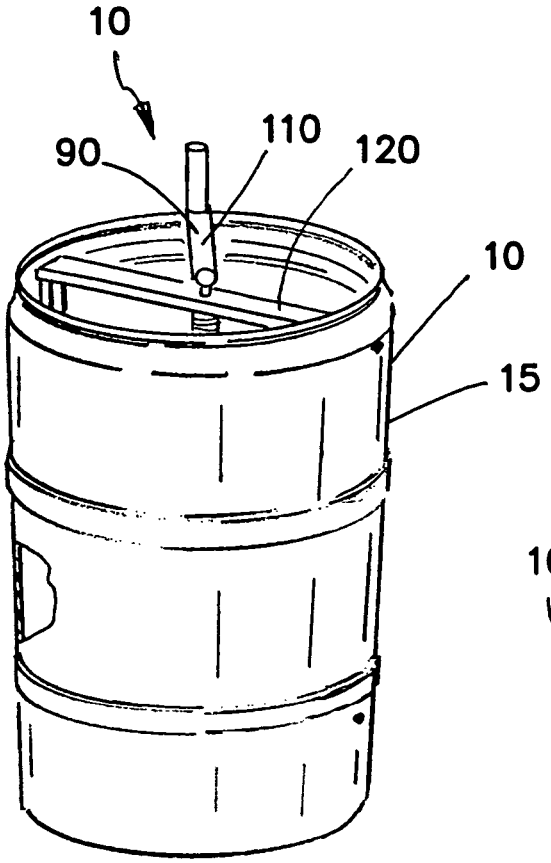
FIG. 1 is a perspective view of the beverage cooler.

DETAILED DESCRIPTION OF THE PREFERRED EMBODIMENT (1) As shown in FIGS. 1–4, a beverage cooler 10 of the present invention may be constructed from the following components. A receptacle 15 is provided. The receptacle 15 has an adjustable platform 20 therein. The platform 20 has at least one orifice 25, therethrough. A raising mechanism 30 is provided. The raising mechanism 30 moves the platform 20 between an upper position 35 and a lower position 40.

(2) In a variant of the invention, as shown in FIGS. 1–5, the receptacle 15 includes a bottom 45, a continuous side wall 50 extending upwardly from the bottom 45 and ending at an open top 55.

Figure 2:
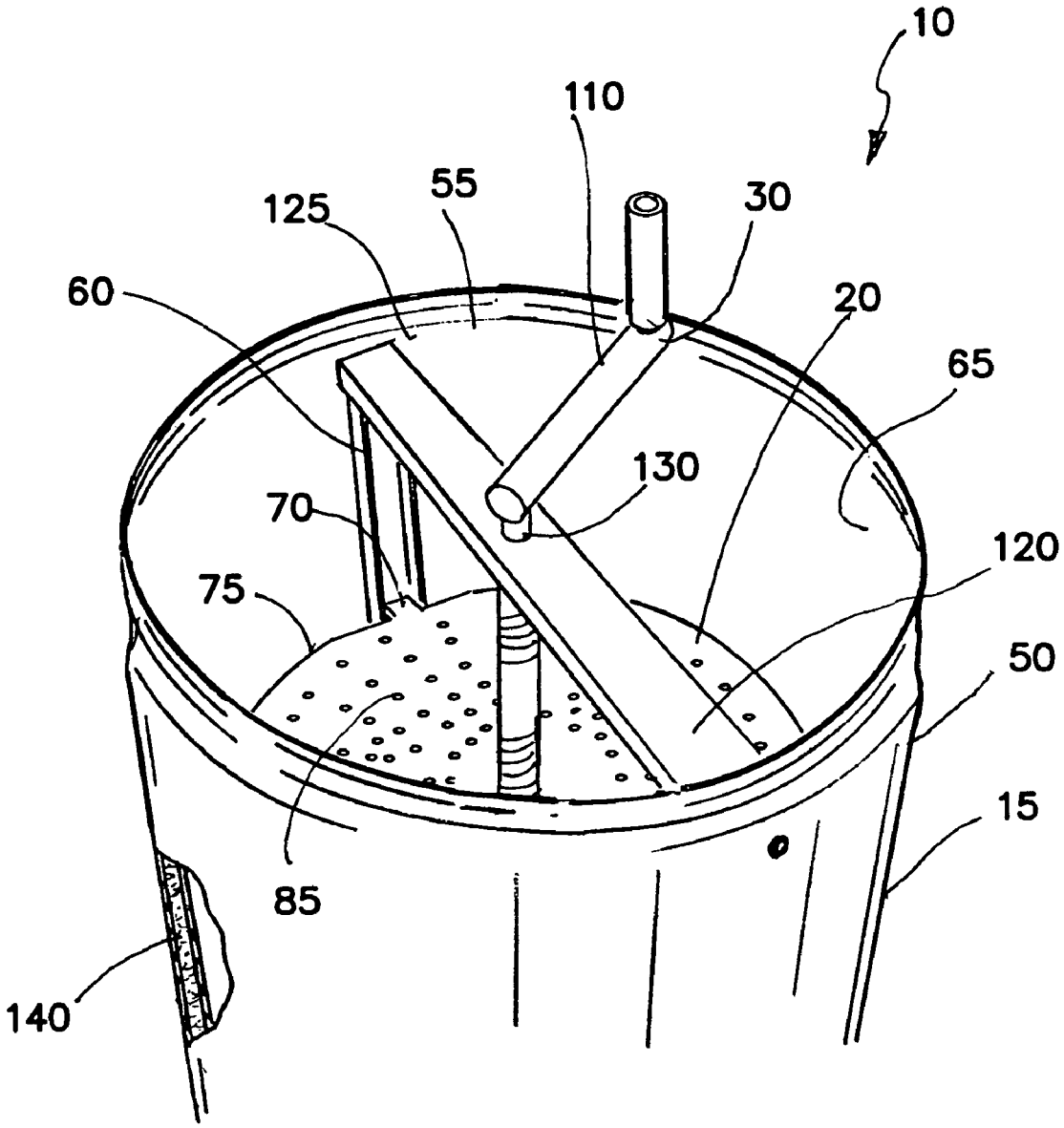
FIG. 2 is a perspective view of a the beverage cooler detailing the raising mechanism, top support bracket, track and adjustable platform.
Figure 3:
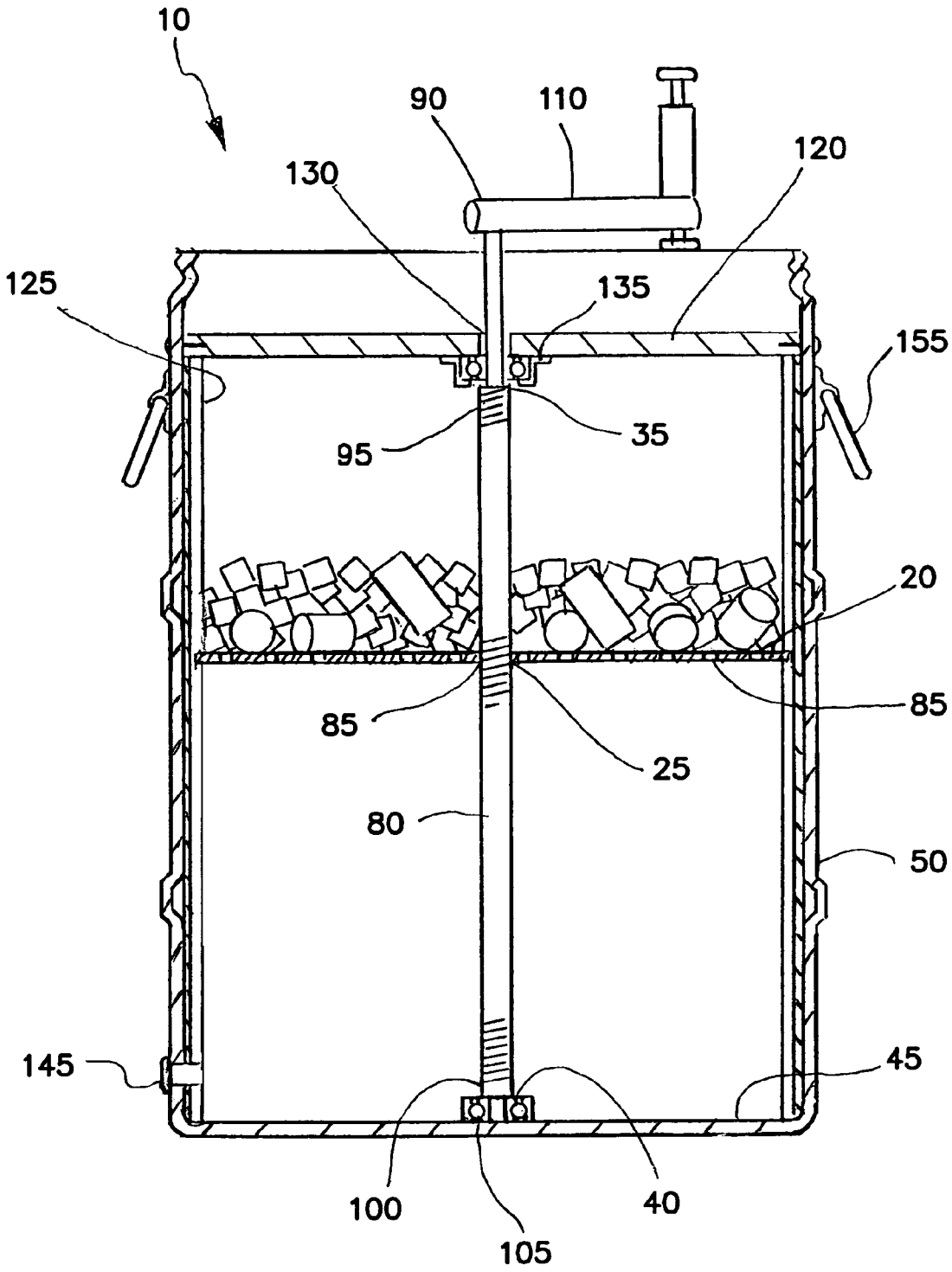
FIG. 3 is a cross-sectional view of the beverage cooler detailing the raising mechanism and adjustable platform.
Figure 4:
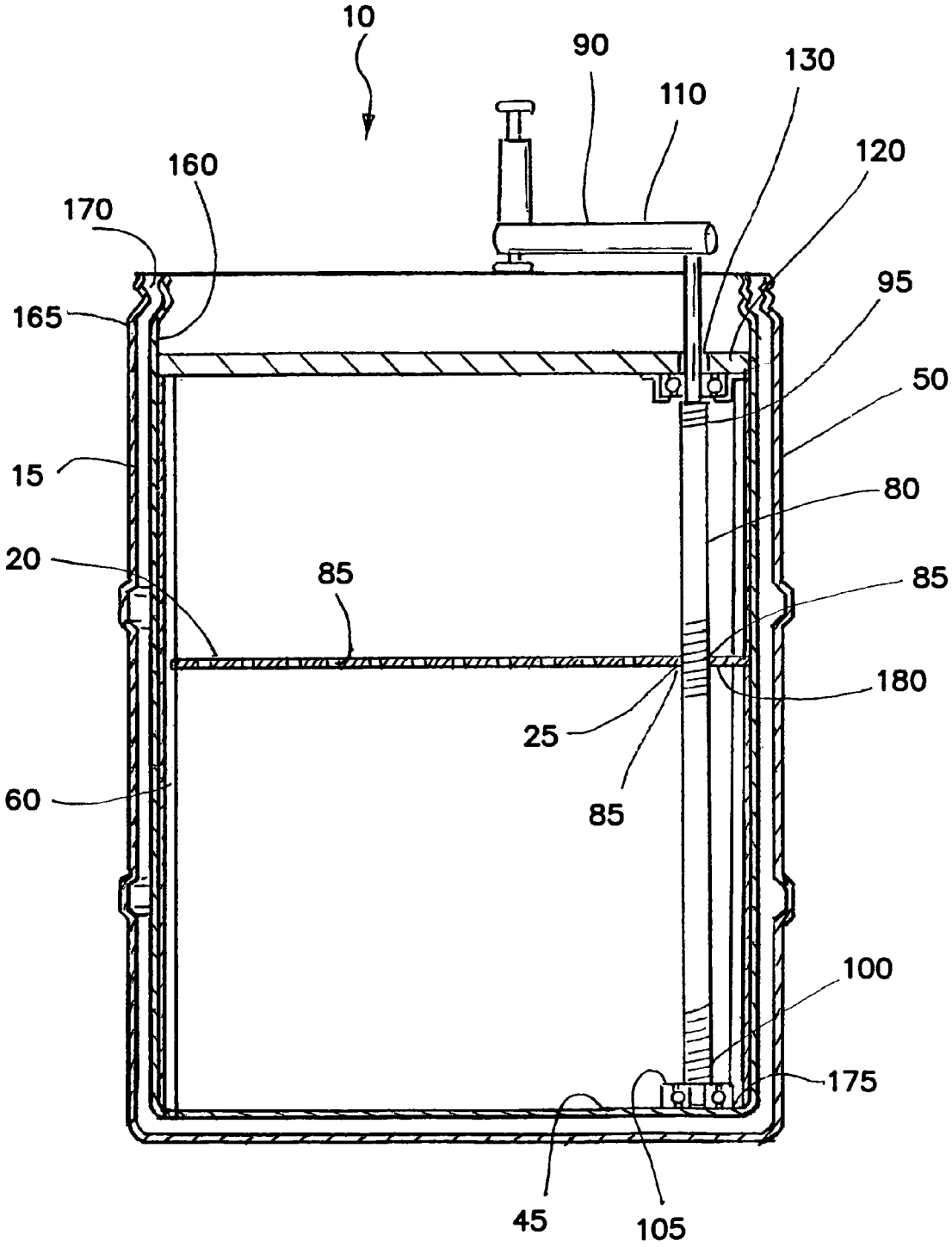
FIG. 4 is a cross-sectional view of the beverage cooler with the threaded shaft located adjacent to an edge of the bottom and the mating threaded orifice located adjacent to an edge of the adjustable platform.

(3) In another variant, a shown in FIGS. 2–4, the raising mechanism 30 includes at least one track 60. The track 60 is located upon an inner surface 65 of the side wall 50. At least one guide 70 is provided. The guide 70 is located at an outer edge 75 of the platform 20. A threaded shaft 80 is provided. A mating threaded orifice 85 located in the platform 20 is provided. A rotating mechanism 90 attached to the threaded shaft 80 is provided.

(4) In still another variant, as shown in FIG. 3, the threaded shaft 80 has a first end 95, a second end 100 and engages a lower bearing 105 secured to the bottom 45.

(5) In yet another variant of the invention, as shown in FIGS. 1–3, the threaded shaft 80 is located centrally on the bottom 45 and the mating threaded orifice 85 is located centrally on the platform 20.

(6) In another variant, as shown in FIGS. 1–4, the rotating mechanism 90 is a crank 110.

(7) In still yet another variant, as shown in FIGS. 1–4, the crank 110 is removably attached to the threaded shaft 80.

Figure 5:
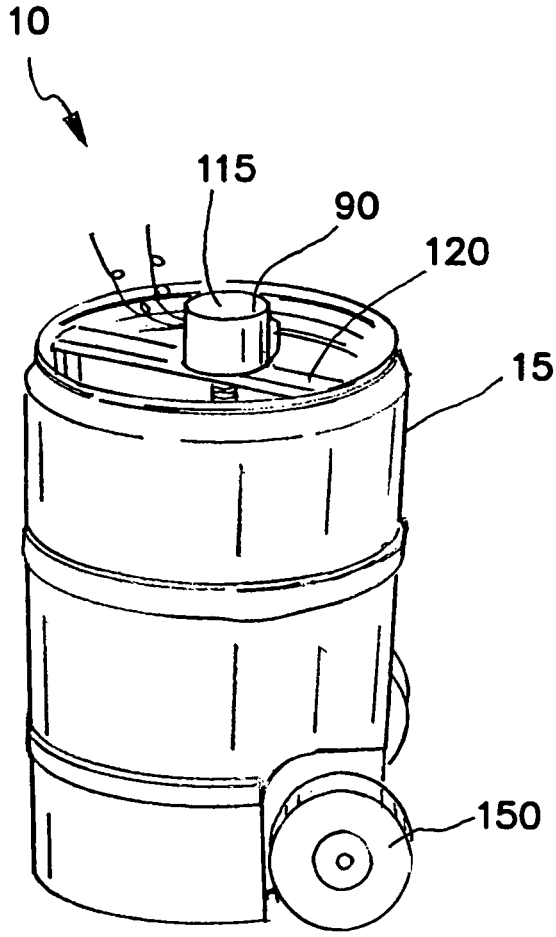
FIG. 5 is a perspective view of the beverage cooler with an electric motor and two wheels.

(8) In another variant of the invention, as shown in FIG. 5, the rotating mechanism 90 is an electric motor 115.

(9) In still another variant, as shown in FIG. 5, the electric motor 115 is removably attached to the threaded shaft 80.

(10) In yet another variant, as shown in FIGS. 1–5, a top support bracket 120 is provided. The top support bracket 120 is located at an upper edge 125 of the side wall 50.

(11) In another variant of the invention, as shown in FIGS. 1–5, the top support bracket 120 is removably attached to the upper edge 125 of the side wall 50.

(12) In still yet another variant, as shown in FIGS. 1–5, the top support bracket 120 further includes an orifice 130 sized and shaped to fit slidably over the threaded shaft 80.

(13) In still another variant of the invention, as shown in FIGS. 3 and 4, the top support bracket 120 includes at least one bearing 135.

(14) In a yet another variant, as shown in FIG. 2, the receptacle 15 includes insulation 140.

(15) In yet another variant of the invention, as shown in FIG. 3, the receptacle 15 includes a drain opening 145.

(16) In still yet another variant, as shown in FIG. 5, the receptacle 15 includes at least two wheels 150.

(17) In another variant, as shown in FIG. 3, the receptacle 15 includes at least one handle 155.

(18) In still another variant of the invention, as shown in FIG. 4, the receptacle 15 includes an inner wall 160, an outer wall 165 and an evacuated space 170 between the inner wall 160 and the outer wall 165.

(19) In a final variant of the invention, as shown in FIG. 4, the threaded shaft 80 is located adjacent to an edge 175 of the bottom 45 and the mating threaded orifice 85 is located adjacent an edge 180 of the platform 20.

The beverage cooler 10 has been described with reference to particular embodiments. Other modifications and enhancements can be made without departing from the spirit and scope of the claims that follow.

The invention claimed is:

1. A beverage cooler, comprising:

a receptacle, said receptacle having an adjustable platform therein; said platform having at least one orifice, therethrough; and a raising mechanism, said raising mechanism moving said platform between an upper position and a lower position; wherein said raising mechanism comprises at least one track, said track being disposed upon an inner surface of said side wall, at least one guide, said guide being disposed at an outer edge of said platform, a threaded shaft, a mating threaded orifice disposed in said platform, and a rotating mechanism attached to said threaded shaft.

2. A beverage cooler as described in claim 1, wherein said receptacle comprises a bottom, a continuous side wall extending upwardly from said bottom and ending at an open top.

3. A beverage cooler as described in claim 1, wherein said threaded shaft has a first end, a second end and engages a lower bearing secured to said bottom.

4. A beverage cooler as described in claim 1, wherein said threaded shaft being disposed centrally on said bottom and said mating threaded orifice being disposed centrally on said platform.

5. A beverage cooler as described in claim 1, wherein said rotating mechanism is a crank.

6. A beverage cooler as described in claim 5, wherein said crank is removably attached to said threaded shaft.

7. A beverage cooler as described in claim 1, wherein said rotating mechanism is an electric motor.

8. A beverage cooler as described in claim 7, wherein said electric motor is removably attached to said threaded shaft.

9. A beverage cooler as described in claim 1, further comprising a top support bracket, said top support bracket being disposed at an upper edge of said side wall.

10. A beverage cooler as described in claim 9, wherein said top support bracket is removably attached to said upper edge of said side wall.

11. A beverage cooler as described in claim 9, wherein said top support bracket further comprises an orifice sized and shaped to fit slidably over said threaded shaft.

12. A beverage cooler as described in claim 9, wherein said top support bracket further includes at least one bearing.

13. A beverage cooler as described in claim 1, wherein said receptacle further includes insulation.

14. A beverage cooler as described in claim 1, wherein said receptacle further includes a drain opening.

15. A beverage cooler as described in claim 1, wherein said receptacle further includes at least two wheels.

16. A beverage cooler as described in claim 1, wherein said receptacle further includes at least one handle.

17. A beverage cooler as described in claim 1, wherein said receptacle comprises an inner wall, an outer wall and an evacuated space between said inner wall and said outer wall.

18. A beverage cooler as described in claim 1, wherein said threaded shaft being disposed adjacent an edge of said bottom and said mating threaded orifice being disposed adjacent an edge of said platform.

* * * * *